US006122388A

United States Patent [19]

Feldman

[11] Patent Number: 6,122,388

[45] Date of Patent: Sep. 19, 2000

[54] EARMOLD DEVICE

[75] Inventor: Mark W. Feldman, Westwood, Mass.

[73] Assignee: EarCandies L.L.C., Westwood, Mass.

[21] Appl. No.: 08/978,537

[22] Filed: Nov. 26, 1997

[51] Int. Cl.[7] ..... H04R 25/00

[52] U.S. Cl. ..... 381/322; 381/328; 381/361; 381/355

[58] Field of Search ..... 381/322, 328, 381/361, 376, 380, 381, 382, 329, 312, 324, 355

[56] References Cited

U.S. PATENT DOCUMENTS

| | | |
|---|---|---|
| 1,624,144 | 4/1927 | Mathieu . |
| 1,668,890 | 5/1928 | Curran et al. . |
| 1,753,817 | 4/1930 | Aber . |
| 2,248,837 | 7/1941 | Walters . |
| 3,440,365 | 4/1969 | Bryant et al. . |
| 4,311,206 | 1/1982 | Johnson . |
| 4,429,194 | 1/1984 | Kamon et al. . |
| 4,443,668 | 4/1984 | Warren . |
| 4,852,177 | 7/1989 | Ambrose . |
| 4,864,610 | 9/1989 | Stevens . |
| 4,878,560 | 11/1989 | Scott . |
| 4,965,838 | 10/1990 | Kamon et al. . |
| 4,972,492 | 11/1990 | Tanaka et al. . |
| 5,048,092 | 9/1991 | Yamagishi et al. . |
| 5,142,587 | 8/1992 | Kobayashi . |
| 5,298,692 | 3/1994 | Ikeda et al. . |
| 5,319,163 | 6/1994 | Scott . |
| 5,345,509 | 9/1994 | Hofer et al. . |
| 5,412,736 | 5/1995 | Keliiliki . |
| 5,448,637 | 9/1995 | Yamaguchi et al. . |
| 5,544,253 | 8/1996 | Nagayoshi et al. . |
| 5,613,222 | 3/1997 | Guenther . |
| 5,659,156 | 8/1997 | Mauncey et al. . |
| 5,677,964 | 10/1997 | Sun . |

*Primary Examiner*—Curtis A. Kuntz
*Assistant Examiner*—Dionne N. Harvey
*Attorney, Agent, or Firm*—Samuels, Gauthier & Stevens

[57] ABSTRACT

An earmold device is disclosed for wearing in a user's ear, and is adapted to receive a communications device. The earmold device includes a distal side, a proximal side, and a circumferential wall. The distal side includes a cavity for receiving a communications device. The proximal side includes a crus helicis protrusion for engagement between the upper base region of the antihelix and the crus helicis of a user's ear. The circumferential wall region is in communication with the distal and proximal sides. The wall region includes an antihelix engaging portion for engagement with the area of the antihelix of a user's ear, and a tragus engaging portion for engagement with the area of the tragus of a user's ear. The earmold is securable within a user's ear by the antihelix and tragus engaging portions of the wall region.

8 Claims, 3 Drawing Sheets

EARMOLD DEVICE

BACKGROUND OF THE INVENTION

The invention generally relates to earpieces including earphones and hearing aids, and specifically relates to earmolds for receiving communications devices.

Conventional earmolds that are adapted to be received within a user's ear, typically include a portion that sealingly engages the auditory canal of a user. Although this may provide relatively secure attachment to a user's ear, the seal created in the auditory canal by such an earmold may cause discomfort.

Moreover, conventional earmolds are not fully satisfactory for use during vigorous exercise. Not only must the earmold be securely held within the user's outer ear while the user is moving, but problems arise as the user begins to perspire. First the seal created between the earmold and the surface of the auditory canal will prevent moisture, e.g., perspiration, from draining out of the auditory canal, causing discomfort or possible health risks. Second, if perspiration does migrate between the surface of the auditory canal and the portion of the earmold that is located within the auditory canal, then secure attachment to the ear will likely be lost since attachment to the ear was achieved by the snug fit between the earmold and the auditory canal.

U.S. Pat. No. 5,659,156 discloses an earmold device that includes an extended helix for aiding in attachment to a user's ear. Attachment to the ear is disclosed to be achieved by twisting the earmold into the ear and an alignment mark is provided to indicate the proper orientation. Although a stated purpose of the design of the '156 earmold device is to minimize contact with the inner ear canal, the '156 patent does disclose an auditory canal protrusion that extends into, and follows the curvature of, the auditory canal of a user's ear. Pneumatic sealing engagement with the auditory canal, however, is avoided by the use of a vent along the side of the protrusion. Although such a design may reduce the possibility of causing a pneumatic seal within the ear canal, it does not achieve all of the objectives of the invention of further minimizing contact with the user's auditory canal and providing secure attachment to a user's ear.

There is a need, therefore, for an earmold device that securely engages a user's outer ear without engaging the user's auditory canal.

There is also a need for an earmold device that permits perspiration to drain from the auditory canal of a user, and to drain from the concha of user's ear.

There is further a need for an earmold device that provides improved sound quality from a communications device into the auditory-canal of a user.

SUMMARY OF THE INVENTION

The invention provides an earmold device that is securable to a user's outer ear without engaging the auditory canal of a user's ear. Earmold devices of the invention generally include a distal side, a proximal side, and a circumferential wall. The distal side includes a cavity for receiving a communications device. The proximal side includes a crus helicis protrusion for engagement between the upper base region of the antihelix and the crus helicis of a user's ear. The circumferential wall region is in communication with the distal and proximal sides. The wall region includes an antihelix engaging portion for engagement with the area of the antihelix of a user's ear, and a tragus engaging portion for engagement with the area of the tragus of a user's ear.

The earmold is securable within a user's ear by the antihelix and tragus engaging portions of the wall region.

BRIEF DESCRIPTION OF THE DRAWINGS

The following detailed description of the illustrated embodiments may be further understood with reference to the accompanying drawings in which.

DETAILED DESCRIPTION OF THE ILLUSTRATED EMBODIMENTS

Figure 1:
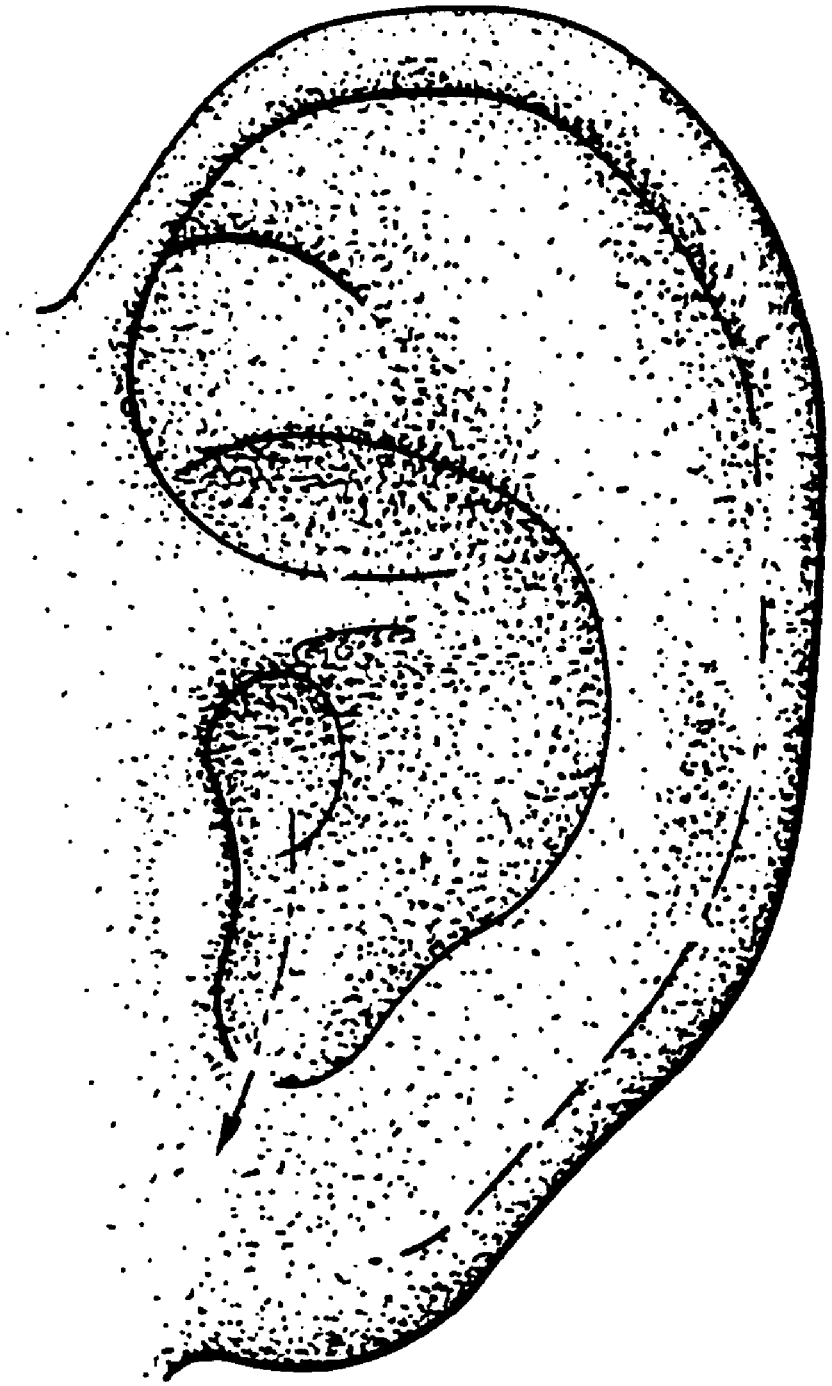
FIG. 1 shows a side view of a human ear.

As shown in FIG. 1, a human ear includes an exterior prominent rim or helix 10 that begins from the crus helicis 12 or the upper base region of the helix, and extends around the outer edge of the ear. Interior to the helix 10 is another curved prominence called the antihelix 14 which also extends from an upper base region 16. The antihelix 14 describes the edge of a deep cavity called the concha 18 which leads to the auditory canal or meatus 20. In front of the concha 18 and projecting backwards over the auditory canal 20 is the tragus 22. Opposite the tragus 22 and separated from it by a deep notch or heel 24 is the antitragus 26. Below the antitragus 26 is the lobule 28.

Figure 3:
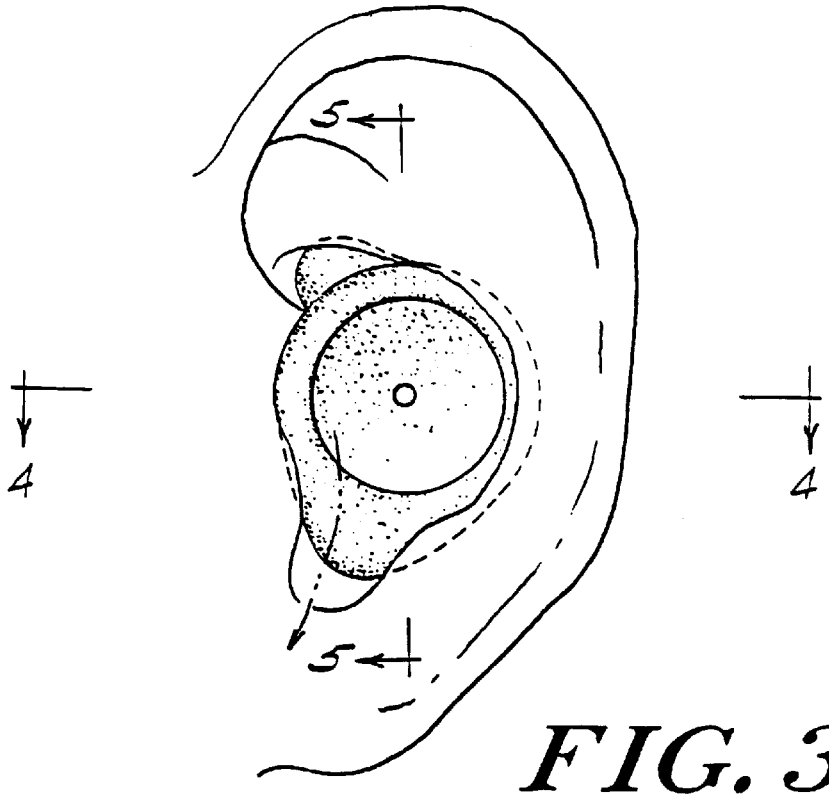
FIG. 3 shows the earmold device of FIG. 2 engaged within a user's ear.
Figure 2:
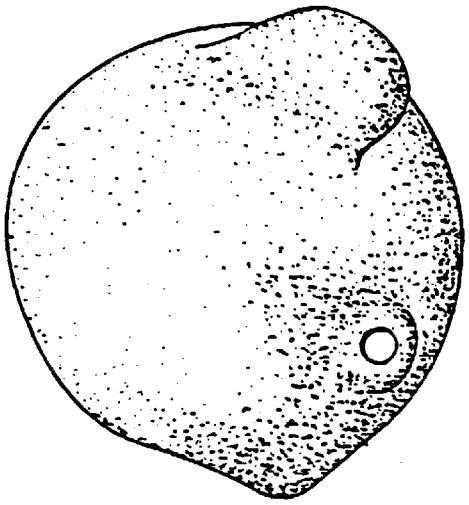
FIG. 2 shows the proximal side of an earmold device of the present invention.

As shown in FIG. 2, an earmold device of the invention 30 includes a helix protrusion 32 and an auditory canal protrusion 34 on its proximal side 36. As shown in FIG. 3, when inserted into an ear, the helix protrusion 32 engages between the upper base region of the antihelix 16 and the crus helicis 12 (not shown in FIG. 3). The device 30 is secured in place by engagement of the regions of the circumferential wall 38 with the area of the antihelix 14 and with area of the tragus 22. Specifically, regions 38*a* engage with inner surface below the edge of the antihelix, and region 38*b* engages the inner surface below the tragus.

Figure 4:
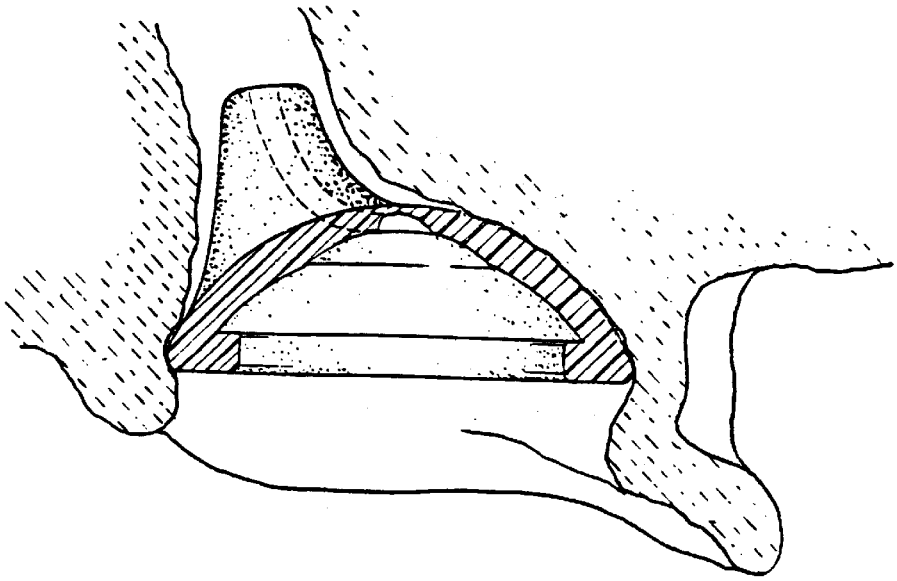
FIG. 4 shows a sectional view of the engaged earmold of FIG. 3 taken along line 4—4 thereof.
Figure 5:
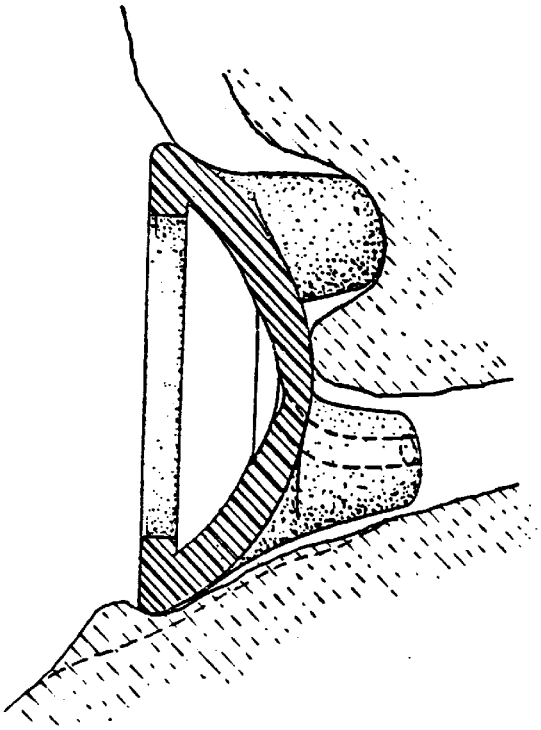
FIG. 5 shows a sectional view of the engaged earmold of FIG. 3 taken along line 5—5 thereof.

As shown in FIG. 4, the auditory canal protrusion extends toward the opening of the auditory canal 20 but does not engage the sides of the canal 20. The earmold device is secured within the outer ear of the user by engagement of the wall regions 38*a* with the area of the antihelix 14, and engagement of the wall region 38*b* with the area of the tragus 22. As shown in FIG. 5, the positioning of the device 30 is further stabilized by the helix protrusion engaging between the upper base region of the antihelix 16 and the crus helicis 12.

As shown in FIGS. 4 and 5 the auditory canal protrusion 34 does not engage the surface of the auditory canal 20. This provides improved comfort, in part, because perspiration may drain through the auditory canal and out through the concha in the direction indicated at A in FIGS. 1 and 3. This also permits moisture to be drawn away from the electronics.

Figure 6:
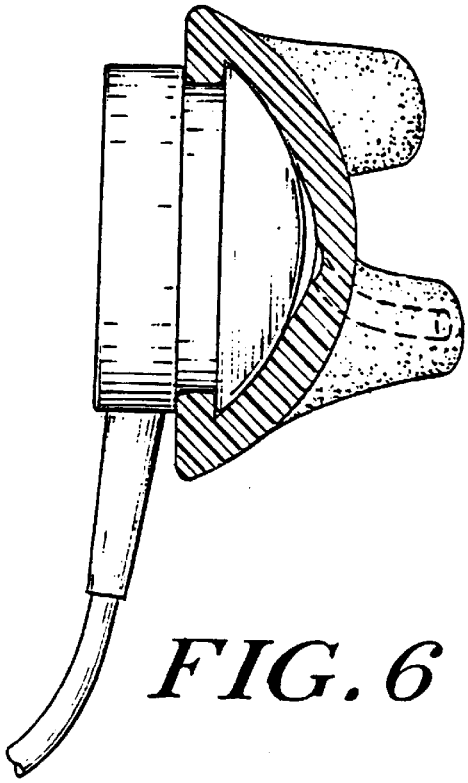
FIG. 6 shows a sectional view of the earmold of FIG. 2 similar to the view shown in FIG. 5, together with an attached communications device.

The earmold device 30 also includes two cavities 40 and 42 on its distal side 44, and a sound channel 46 extending from the second cavity 42 through the auditory canal protrusion 34. A communication device 48 may be received within the first cavity 40 as shown in FIGS. 5 and 6, leaving the second cavity 42 open for receiving and directing sound from the communication device 48 into the sound channel 46. The communication device 48 may be secured within the first cavity 40 by engaging an annular collar 50 on the communications device 48 behind an annular flange 52 on the earmold device 30.

Earmold devices of the invention may be made from any soft, flexible material and are preferably made from a hypo-allergenic material. The earmolds may also include a reflective material for safety of the user during use. Earmold devices of the invention are suitable for use for stereo earphone listening with any industry standard WALKMAN or EARBUD stereo system, and provide improved sound transmission as well as improved comfort and stability.

Those skilled in the art will appreciate that modifications and variations may be made to the above disclosed embodiments without departing from the spirit and scope of the invention.

What is claimed is:

1. An earmold device for wearing in a user's ear and adapted to receive a communications device, said earmold device comprising:

a distal side including a cavity for receiving a communications device therein;

a proximal side including a crus helicis protrusion for engagement between the upper base region of the antihelix and the crus helicis of a user's ear; and a circumferential wall region in communication with said distal and proximal sides, said circumferential wall region including an antihelix engaging portion for engagement with the area of the antihelix of a user's ear, and a tragus engaging portion for engagement with the area of the tragus of a user's ear, said earmold being solely securable within a user's ear by said crus helicis protrusion and said antihelix and tragus engaging portions of said wall region.

2. An earmold device as claimed in claim 1, wherein said proximal side of said earmold device further includes an auditory canal protrusion extending toward the auditory canal of a user.

3. An earmold device as claimed in claim 2, wherein said auditory canal protrusion includes a sound channel for channeling sound from said communication device into the auditory canal of a user.

4. An earmold device as claimed in claim 2, wherein said auditory canal protrusion is sized to non-sealingly fit within the opening of the user's auditory canal.

5. An earmold device as claimed in claim 1, wherein said distal side of said device further includes a sound cavity adjacent said cavity for receiving a communications device.

6. An earmold device as claimed in claim 1, wherein said device permits fluid from within the auditory canal of a user's ear to drain into the concha of a user's ear.

7. An earmold device as claimed in claim 1, wherein said device permits fluid from within the concha of a user's ear to drain along the heel of a user's ear.

8. An earmold device as claimed in claim 1, wherein said cavity is defined by an annular flange for engaging a communications device.

* * * * *